US011428378B1

(12) United States Patent
Chiang et al.

(10) Patent No.: US 11,428,378 B1
(45) Date of Patent: Aug. 30, 2022

(54) VEHICLE LAMP DEVICE AND PROJECTION LENS FOR VEHICLE LAMP

(71) Applicant: Young Optics Inc., Hsinchu (TW)

(72) Inventors: Chen-An Chiang, Hsinchu (TW); S-Wei Chen, Hsinchu (TW)

(73) Assignee: Young Optics Inc., Hsinchu (TW)

( * ) Notice: Subject to any disclaimer, the term of this patent is extended or adjusted under 35 U.S.C. 154(b) by 0 days.

(21) Appl. No.: 17/227,397

(22) Filed: Apr. 12, 2021

(51) Int. Cl.

| | |
|---|---|
| ***F21S 41/40*** | (2018.01) |
| ***F21S 41/25*** | (2018.01) |
| ***F21S 41/153*** | (2018.01) |
| ***F21S 41/143*** | (2018.01) |
| *F21Y 115/10* | (2016.01) |
| *F21Y 105/10* | (2016.01) |

(52) U.S. Cl.
CPC ..... *F21S 41/25* (2018.01); *F21S 41/143* (2018.01); *F21S 41/153* (2018.01); *F21S 41/40* (2018.01); *F21Y 2105/10* (2016.08); *F21Y 2115/10* (2016.08)

(58) Field of Classification Search
None
See application file for complete search history.

(56) References Cited

U.S. PATENT DOCUMENTS

| | | | | |
|---|---|---|---|---|
| 9,074,747 | B2 | 7/2015 | Abe | |
| 10,877,252 | B2 * | 12/2020 | Chen | G02B 5/005 |
| 2010/0128233 | A1 * | 5/2010 | Liu | G03B 21/28 353/98 |
| 2015/0268446 | A1 * | 9/2015 | Chen | G02B 13/0045 348/148 |
| 2016/0363745 | A1 * | 12/2016 | Kubota | G02B 15/145513 |
| 2019/0086646 | A1 * | 3/2019 | Chen | G02B 13/006 |
| 2019/0121093 | A1 * | 4/2019 | Gong | G02B 17/0852 |
| 2019/0331900 | A1 * | 10/2019 | Yao | G02B 13/0045 |
| 2021/0215916 | A1 * | 7/2021 | Lin | G02B 13/006 |

FOREIGN PATENT DOCUMENTS

| | | |
|---|---|---|
| CN | 104471310 | 3/2015 |
| CN | 105351839 | 2/2018 |
| TW | I546491 | 8/2016 |
| TW | I637125 | 10/2018 |
| TW | I717218 | 1/2021 |

* cited by examiner

*Primary Examiner* — Elmito Breval
(74) *Attorney, Agent, or Firm* — JCIPRNET

(57) ABSTRACT

A vehicle lamp device including a matrix image light source, a projection lens, and a vehicle lampshade is provided. The projection lens has an optical axis and is disposed in a downstream of an optical path of the matrix image light source. The vehicle lampshade is disposed in a downstream of an optical path of the projection lens. The projection lens includes two to three optical lenses, and a projection aspect ratio of the projection lens is between 2.5:1 and 6:1. A distance between optical centers of outermost lens surfaces at both ends of the projection lens is between 54 millimeters and 76 millimeters. In addition, a projection lens for a vehicle lamp is also proposed.

20 Claims, 12 Drawing Sheets

| First embodiment | | | | | | |
|---|---|---|---|---|---|---|
| Element | Surface | Radius of curvature (mm) | Spacing (mm) | Refractive index | Abbe number | Radius (mm) |
| First lens 110 (biconvex) | Surface 112 | 60.27 | 9.20 | 1.49 | 57.44 | 23.80 |
| | Surface 114 | -211.49 | 31.82 | | | 22.89 |
| Second lens 120 (biconvex) and aperture ST | Surface 122 | 55.15 | 8.38 | 1.52 | 64.20 | 17.42 |
| | Surface 124 | -55.15 | 0.20 | | | 17.27 |
| Third lens 130 (meniscus) | Surface 132 | 19.67 | 11.57 | 1.57 | 56.06 | 13.50 |
| | Surface 134 | 41.57 | 7.52 | | | 10.43 |
| Image light source 200 | Surface LS | Infinity | 0.00 | | | 7.26 |

FIG. 1B

| Surface | Surface coefficient | 4th order aspheric coefficient | 6th order aspheric coefficient | 8th order aspheric coefficient | 10th order aspheric coefficient | 12th order aspheric coefficient | 14th order aspheric coefficient | 16th order aspheric coefficient |
|---|---|---|---|---|---|---|---|---|
| Surface 112 | -15.96 | 1.296E-05 | -2.158E-08 | 1.305E-11 | -4.355E-15 | 1.105E-17 | 2.086E-20 | -8.412E-24 |
| Surface 114 | 45.64 | 8.793E-06 | -1.319E-08 | 4.947E-12 | 1.569E-14 | 7.915E-18 | -1.504E-21 | 3.118E-23 |

FIG. 1C

| Second embodiment | | | | | | |
|---|---|---|---|---|---|---|
| Element | Surface | Radius of curvature (mm) | Spacing (mm) | Refractive index | Abbe number | Radius (mm) |
| First lens 110 (biconvex) | Surface 112 | 54.09 | 10.81 | 1.49 | 57.44 | 24.20 |
| | Surface 114 | -184.87 | 29.60 | | | 23.02 |
| Second lens 120 (biconvex) and aperture ST | Surface 122 | 60.56 | 9.86 | 1.52 | 64.20 | 17.65 |
| | Surface 124 | -60.56 | 0.20 | | | 17.00 |
| Third lens 130 (meniscus) | Surface 132 | 18.60 | 11.17 | 1.52 | 64.20 | 13.76 |
| | Surface 134 | 96.45 | 6.96 | | | 10.50 |
| Image light source 200 | Surface LS | Infinity | 0.00 | | | 7.15 |

FIG. 2B

| Surface | Surface coefficient | 4th order aspheric coefficient | 6th order aspheric coefficient | 8th order aspheric coefficient | 10th order aspheric coefficient | 12th order aspheric coefficient | 14th order aspheric coefficient | 16th order aspheric coefficient |
|---|---|---|---|---|---|---|---|---|
| Surface 112 | -17.50 | 1.313E-05 | -2.174E-08 | 1.260E-11 | -2.497E-15 | 1.583E-17 | 2.184E-20 | -1.756E-23 |
| Surface 114 | 40.85 | 8.071E-06 | -1.331E-08 | 6.496E-12 | 1.696E-14 | 5.801E-18 | -1.775E-21 | 5.058E-23 |

FIG. 2C

| Third embodiment | | | | | | |
|---|---|---|---|---|---|---|
| Element | Surface | Radius of curvature (mm) | Spacing (mm) | Refractive index | Abbe number | Radius (mm) |
| First lens 110 (meniscus) | Surface 112 | 38.67 | 10.62 | 1.58 | 30.37 | 25.00 |
| | Surface 114 | 85.22 | 4.98 | | | 22.84 |
| Aperture ST | | Infinity | 8.24 | | | 22.85 |
| Second lens 120 (biconvex) | Surface 122 | 128.19 | 15.00 | 1.50 | 81.61 | 24.74 |
| | Surface 124 | -38.93 | 7.62 | | | 24.27 |
| Third lens 130 (meniscus) | Surface 132 | 19.23 | 16.05 | 1.50 | 81.61 | 16.58 |
| | Surface 134 | 68.71 | 5.44 | | | 8.86 |
| Image light source 200 | Surface LS | Infinity | 0.00 | | | 7.88 |

FIG. 3B

| Surface | Surface coefficient | 4th order aspheric coefficient | 6th order aspheric coefficient | 8th order aspheric coefficient | 10th order aspheric coefficient |
|---|---|---|---|---|---|
| Surface 112 | -11.10 | 1.886E-05 | -1.828E-08 | 4.805E-12 | -2.100E-14 |
| Surface 114 | 3.22 | 1.514E-05 | -1.597E-08 | -5.591E-12 | 4.135E-15 |

FIG. 3C

| Fourth embodiment | | | | | | |
|---|---|---|---|---|---|---|
| Element | Surface | Radius of curvature (mm) | Spacing (mm) | Refractive index | Abbe number | Radius (mm) |
| First lens 110 (meniscus) | Surface 112 | 40.61 | 11.55 | 1.58 | 30.37 | 24.55 |
| | Surface 114 | 110.71 | 4.40 | | | 22.58 |
| Aperture ST | | Infinity | 8.87 | | | 22.57 |
| Second lens 120 (biconvex) | Surface 122 | 105.47 | 15.00 | 1.49 | 70.44 | 24.84 |
| | Surface 124 | -42.33 | 7.73 | | | 25.01 |
| Third lens 130 (meniscus) | Surface 132 | 18.19 | 15.76 | 1.49 | 70.44 | 16.14 |
| | Surface 134 | 72.87 | 4.58 | | | 11.36 |
| Image light source 200 | Surface LS | Infinity | 0.00 | | | 7.32 |

FIG. 4B

| Surface | Surface coefficient | 4th order aspheric coefficient | 6th order aspheric coefficient | 8th order aspheric coefficient | 10th order aspheric coefficient |
|---|---|---|---|---|---|
| Surface 112 | -10.10 | 1.791E-05 | -1.742E-08 | 8.353E-12 | -1.671E-14 |
| Surface 114 | 4.62 | 1.548E-05 | -1.477E-08 | -4.817E-12 | 4.153E-15 |

FIG. 4C

| Fifth embodiment | | | | | | |
|---|---|---|---|---|---|---|
| Element | Surface | Radius of curvature (mm) | Spacing (mm) | Refractive index | Abbe number | Radius (mm) |
| First lens 110 (biconvex) | Surface 112 | 113.82 | 6.75 | 1.49 | 57.44 | 24.00 |
| | Surface 114 | -92.66 | 29.60 | | | 23.91 |
| Aperture ST | | Infinity | 2.44 | | | 18.26 |
| Second lens 120 (biconvex) | Surface 122 | 39.44 | 15.00 | 1.52 | 64.20 | 17.93 |
| | Surface 124 | -98.62 | 6.03 | | | 16.32 |
| Third lens 130 (meniscus) | Surface 132 | 15.78 | 9.26 | 1.52 | 64.20 | 11.63 |
| | Surface 134 | 96.31 | 5.05 | | | 9.00 |
| Image light source 200 | Surface LS | Infinity | 0.00 | | | 7.23 |

FIG. 5B

| Surface | Surface coefficient | 4th order aspheric coefficient | 6th order aspheric coefficient | 8th order aspheric coefficient | 10th order aspheric coefficient |
|---|---|---|---|---|---|
| Surface 112 | 6.40 | 3.284E-06 | -1.596E-08 | -2.727E-12 | 2.142E-14 |
| Surface 114 | -3.11 | 5.277E-06 | -1.379E-08 | -4.249E-12 | 2.334E-14 |

FIG. 5C

| Sixth embodiment | | | | | | |
|---|---|---|---|---|---|---|
| Element | Surface | Radius of curvature (mm) | Spacing (mm) | Refractive index | Abbe number | Radius (mm) |
| First lens 110 (meniscus) | Surface 112 | 34.91 | 10.16 | 1.49 | 57.44 | 22.00 |
| | Surface 114 | 113.31 | 40.08 | | | 21.67 |
| Aperture ST | | Infinity | -3.94 | | | 11.53 |
| Second lens 120 (meniscus) | Surface 122 | 18.82 | 20.65 | 1.81 | 25.48 | 11.53 |
| | Surface 124 | 89.27 | 3.56 | | | 7.86 |
| Image light source 200 | Surface LS | Infinity | 0.00 | | | 6.83 |

FIG. 6B

| Surface | Surface coefficient | 4th order aspheric coefficient | 6th order aspheric coefficient | 8th order aspheric coefficient | 10th order aspheric coefficient | 12th order aspheric coefficient | 14th order aspheric coefficient | 16th order aspheric coefficient |
|---|---|---|---|---|---|---|---|---|
| Surface 112 | -0.38 | 8.411E-06 | -6.005E-08 | 1.203E-10 | -6.673E-14 | -1.240E-16 | 2.116E-19 | -1.429E-22 |
| Surface 114 | 11.55 | -8.313E-06 | 5.716E-09 | -2.012E-11 | 6.161E-14 | -6.691E-18 | -2.144E-19 | 1.711E-22 |

FIG. 6C

VEHICLE LAMP DEVICE AND PROJECTION LENS FOR VEHICLE LAMP

BACKGROUND

Technical Field

The disclosure relates to a projection device and a lens, and in particular to a vehicle lamp device and a projection lens for a vehicle lamp.

Description of Related Art

In order to ensure driving safety, there are certain specifications for luminance and light field distribution of vehicle headlamp illumination. In addition, energy saving and efficiency have always been important requirements for vehicle illumination.

Generally, a light source, including a halogen lamp, a metal lamp, and a light emitting diode (LED) lamp, cannot be directly used for projection. Steps of changing the light field need to be completed to meet the illumination requirements of a vehicle headlamp. Currently, a non-imaging optical technology is used in a vehicle lamp device to guide or adjust an illumination beam from a light source to meet the technical specifications for the vehicle headlamp in various countries. Properly adjusting the vehicle lamp illumination, providing proper luminance and light field, and ensuring driving safety and pedestrian warning are important issues in the field.

SUMMARY

The disclosure provides a vehicle lamp device and a projection lens for a vehicle lamp. Specifically, the disclosure provides a mobile illumination and warning device with a small number of lenses, a large aperture, and high efficiency that complies with regulatory requirements, and a projection lens for the device.

The disclosure provides a vehicle lamp device including a matrix image light source, a projection lens, and a vehicle lampshade. The projection lens is disposed in a downstream of an optical path of the matrix image light source. The vehicle lampshade is disposed in a downstream of an optical path of the projection lens. The projection lens includes two to three diopter lenses, and a distance between optical centers of outermost lens surfaces at both ends of the projection lens is between 54 millimeters and 76 millimeters.

The disclosure further provides a projection lens for a vehicle lamp including two to three diopter lenses. An aperture of the projection lens is disposed between outermost lens surfaces at both ends of the projection lens, and the projection lens satisfies the following conditions: (1) an F-number is between 0.6 and 0.85; (2) a distance between optical centers of the outermost lens surfaces at both ends of the projection lens is between 54 millimeters and 76 millimeters; and (3) a projection aspect ratio is between 2.5:1 and 6:1.

Based on the above, the vehicle lamp device and the projection lens of the disclosure use a small number of lenses, provide projection or illumination with a large aperture and high light emitting efficiency, and comply with regulatory requirements. Therefore, production cost is reduced, and illumination and warning are improved or energy consumption is reduced. In addition, the projection lens according to the embodiments of the disclosure has a short lens total length, and the short lens total length improves flexibility of the overall assembly when the projection lens is used as a vehicle lamp device or other vehicle illumination or warning apparatuses.

To further describe the features and advantages of the disclosure as described above, embodiments accompanied with drawings are described below.

BRIEF DESCRIPTION OF THE DRAWINGS

FIGS. 1A, 1B, and 1C respectively show a schematic diagram, detailed optical data, and aspheric parameters of a vehicle lamp device according to the first embodiment of the disclosure.

FIGS. 2A, 2B, and 2C respectively show a schematic diagram, detailed optical data, and aspheric parameters of a vehicle lamp device according to the second embodiment of the disclosure.

FIGS. 3A, 3B, and 3C respectively show a schematic diagram, detailed optical data, and aspheric parameters of a vehicle lamp device according to the third embodiment of the disclosure.

FIGS. 4A, 4B, and 4C respectively show a schematic diagram, detailed optical data, and aspheric parameters of a vehicle lamp device according to the fourth embodiment of the disclosure.

FIGS. 5A, 5B, and 5C respectively show a schematic diagram, detailed optical data, and aspheric parameters of a vehicle lamp device according to the fifth embodiment of the disclosure.

FIGS. 6A, 6B, and 6C respectively show a schematic diagram, detailed optical data, and aspheric parameters of a vehicle lamp device according to the sixth embodiment of the disclosure.

DESCRIPTION OF THE EMBODIMENTS

Figure 1A:
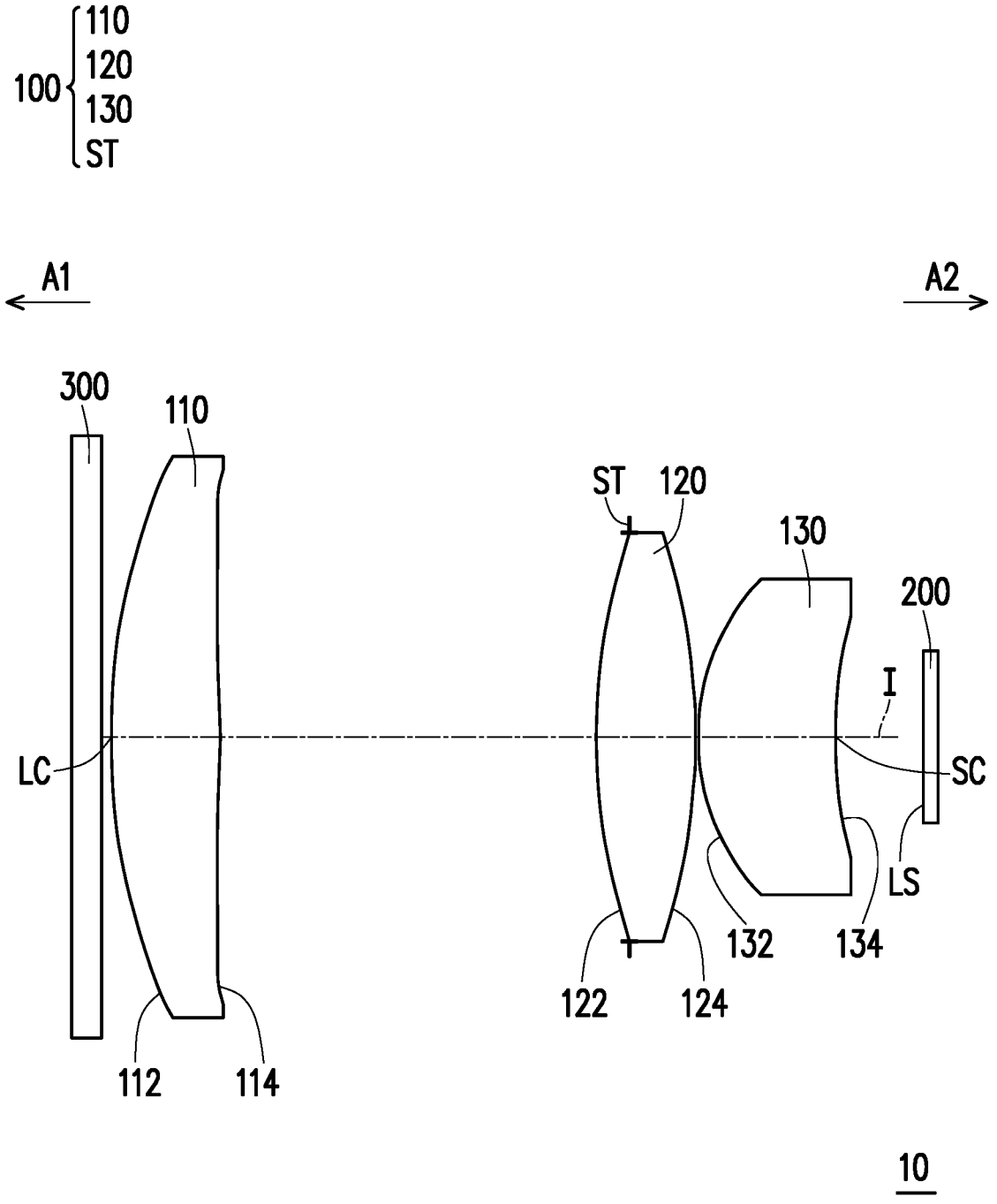

FIG. 1A is a schematic diagram of a vehicle lamp device according to the first embodiment of the disclosure. Referring to FIG. 1A, this embodiment provides a vehicle lamp device 10. The vehicle lamp device 10 may provide a mobile illumination or warning device with a small number of lenses, a large aperture, and high efficiency. In this embodiment, the vehicle lamp device 10 includes a projection lens 100, a matrix image light source 200, and a vehicle lampshade 300. The matrix image light source 200 is configured to provide an image beam (not shown). The projection lens 100 is disposed in a downstream of an optical path of the matrix image light source 200 to project the image beam out of the vehicle lamp device 10 onto a projection target (not shown), for example, a road surface or a wall surface. The vehicle lamp device 10 according to this embodiment further includes the vehicle lampshade 300 disposed in the downstream of the optical path of the projection lens 100. After the image beam is projected from the projection lens 100, the image beam is projected onto the projection target through the vehicle lampshade 300. The vehicle lampshade 300 may further adjust the image beam, or may have the function of protecting the projection lens 100, the matrix image light source 200 or other vehicle lamp devices, but the disclosure is not limited thereto. The vehicle lamp device 10 according to this embodiment may be used as a lamp installed on a car, for example, a high beam lamp, a low beam lamp, a position lamp, a brake lamp, a backup lamp, a tail lamp, a fog lamp, a license plate lamp, a daytime running lamp, a turn signal lamp, etc. The disclosure is not limited thereto.

Specifically, in this embodiment, the matrix image light source 200 is, for example, a micro light emitting diode array (micro LED array) or a digital micromirror device (DMD), but the disclosure is not limited thereto. The matrix image light source 200 may provide the image beam, and the projection lens 100 projects the image beam onto the road surface or the wall surface, etc., so as to meet regulatory requirements and provide early warning to users and pedestrians on the road. For example, the image beam may be a beam with high light intensity and no specific pattern, so that the beam may be used in driving as an illuminating light with sufficient luminance and complying with the regulations. The image beam may also be presented as a beam with a specific pattern according to needs, for example, a geometric pattern such as an arrow, a square, a triangle, a circle, etc. so as to be used as a pattern or signal for informing purposes in driving.

FIG. 1B shows detailed optical data of the vehicle lamp device 10 according to the first embodiment of the disclosure. FIG. 1C shows aspheric parameters of the vehicle lamp device 10 according to the first embodiment of the disclosure. Referring to FIGS. 1A to 1C, the projection lens 100 includes two to three diopter lenses. That is, the projection lens 100 may include a combination of two or three optical lenses whose diopters are all not zero. The projection lens 100 may be a projection lens used for a vehicle lamp, too. The projection lens 100 has an optical axis I. The optical axis I may be an optical axis of a combination of optical lenses. The combination of optical lenses is disposed in the downstream of the optical path of the matrix image light source 200 to magnify the image beam and project the image beam to the projection target. The projection lens 100 may be designed to at least include one plastic lens, for example: at least one portion of the lenses are plastic lenses, and at least another portion of the lenses are glass lenses, but the disclosure is not limited thereto. The lens in the projection lens 100 may be a glass-plastic hybrid lens, too, but the disclosure is not limited thereto. In addition, the projection lens 100 may not include a glued lens, but the disclosure is not limited thereto.

As shown in FIG. 1A, in the vehicle lamp device 10 of this embodiment, the projection lens 100 includes three diopter lenses. Specifically, the projection lens 100 may have a magnification side Al facing the vehicle lampshade 300 and a reduction side A2 facing the matrix image light source 200. The projection lens 100 includes a first lens 110, a second lens 120, and a third lens 130 in order from the magnification side Al to the reduction side A2.

The first lens 110 is a plastic lens and an aspheric lens. The first lens 110 has a positive diopter and is a biconvex lens. In the first lens 110, a magnification side surface 112 facing the magnification side Al is a convex surface, and a reduction side surface 114 facing the reduction side A2 is a convex surface.

The second lens 120 has a positive diopter and is a biconvex lens. In the second lens 120, a magnification side surface 122 facing the magnification side Al is a convex surface, and a reduction side surface 124 facing the reduction side A2 is a convex surface.

The third lens 130 has a positive diopter and is a meniscus lens. In the third lens 130, a magnification side surface 132 facing the magnification side Al is a convex surface, and a reduction side surface 134 facing the reduction side A2 is a concave surface.

The projection lens 100 further includes an aperture ST. In this embodiment, the aperture ST is disposed between outermost lens surfaces (that is, the magnification side surface 112 of the first lens 110 and the reduction side surface 134 of the third lens 130) at both ends of the projection lens 100. An F-number is between 0.6 and 0.85. The aperture ST may be disposed on a surface of one of the lenses. In this embodiment, the aperture ST is disposed on the magnification side surface 122 of the second lens 120, for example, the magnification side surface 122 of the second lens 120 is used as the aperture, or a mechanic part surrounding the magnification side surface 122 of the second lens 120 is used as the aperture.

In this embodiment, the magnification side surfaces 122 and 132 and the reduction side surfaces 124 and 134 of the second lens 120 and the third lens 130 may all be aspherical and may be spherical, too, and the disclosure is not limited thereto. The second lens 120 and the third lens 130 may be plastic lenses or glass lenses, and the disclosure is not limited thereto. In addition, the matrix image light source 200 has a luminous surface LS, and the image beam is emitted from the luminous surface LS. Other detailed optical data of this embodiment are shown in FIGS. 1B and 1C. Aspherical coefficients of the magnification side surface 112 and the reduction side surface 114 of the first lens 110 are respectively shown in the fields of FIG. 1C.

In addition, in this embodiment, a lens total length TTL of the projection lens 100 is less than 80 millimeters. That is, a distance between the luminous surface LS of the matrix image light source 200 and a lens surface of the projection lens 100 farthest from the matrix image light source 200 (i.e., the magnification side surface 112 of the first lens 110) on the optical axis I is less than 80 millimeters.

In this embodiment, a distance between optical centers LC and SC of the outermost lens surfaces at both ends of the projection lens 100 is between 54 millimeters and 76 millimeters. That is, a distance (a total length of the multiple lenses of the projection lens 100 on the optical axis) between an optical center of the magnification side surface 112 of the first lens 110 and an optical center of the reduction side surface 134 of the third lens 130 is between 54 millimeters and 76 millimeters. In addition, a projection aspect ratio of the projection lens 100 is between 2.5:1 and 6:1, so that the projection lens 100 may provide a horizontal angle of view of between 14 and 40 degrees and a vertical angle of view of between 5 and 10 degrees, so as to provide projection that complies with relevant regulations.

In this embodiment, the matrix image light source 200 may include multiple micro LEDs. In this embodiment, the matrix image light source 200 may be a micro LED array with a length of about 12.8 millimeters and a width of about 3.2 millimeters, and may, for example, have a pixel size of 256x64 pixels and 50 microns. A spatial frequency of the matrix image light source 200 may be 10 line pairs/millimeter.

As noted above, the vehicle lamp device 10 of this embodiment has an F-number less than or equal to 0.85, so that the vehicle lamp device 10 may provide a large aperture and improve light emitting efficiency. In addition, the vehicle lamp device 10 may have a projection aspect ratio between 2.5:1 and 6:1, and may provide a horizontal angle of view of between 14 and 40 degrees and a vertical angle of view of between 5 and 10 degrees, so as to comply with relevant regulations. Furthermore, this embodiment uses three lenses and the lens total length is less than or equal to 80 millimeters. This embodiment uses a small number of lenses, and has a shorter lens total length. This embodiment further includes at least one plastic lens. The inclusion of the at least one plastic lens may further reduce costs.

Figure 2A:
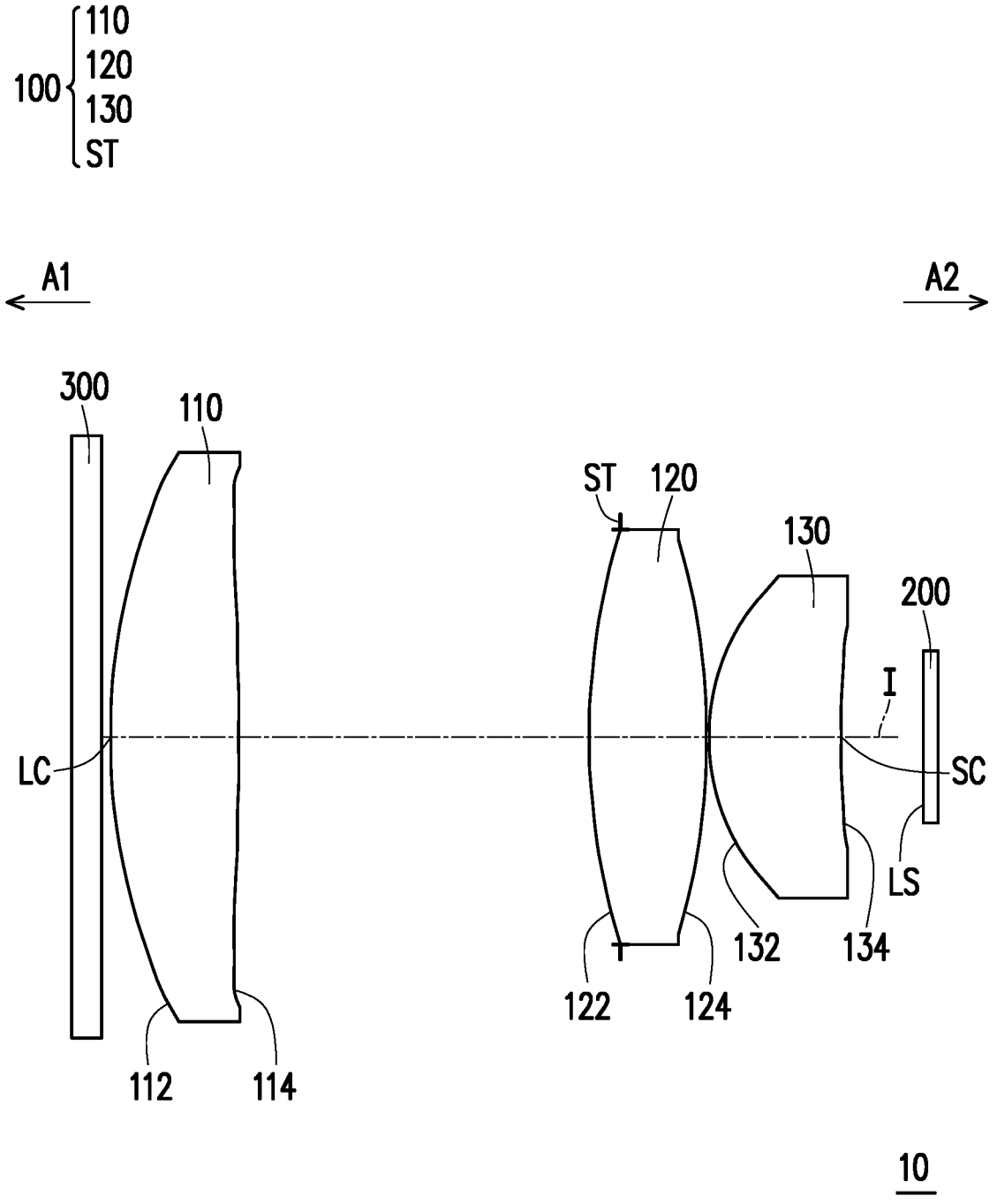

FIG. 2A is a schematic diagram of the vehicle lamp device 10 according to the second embodiment of the disclosure. FIG. 2B shows detailed optical data of the vehicle lamp device according to the second embodiment of the disclosure. FIG. 2C shows aspheric parameters of the vehicle lamp device according to the second embodiment of the disclosure. Referring to FIGS. 2A to 2C, the second embodiment of the vehicle lamp device 10 of the disclosure is roughly similar to the first embodiment, and the difference between the two embodiments is as follows. The first lens 110, the second lens 120, and the third lens 130 have different parameters, including optical data, aspheric coefficients, and spacing of each element.

Figure 3A:
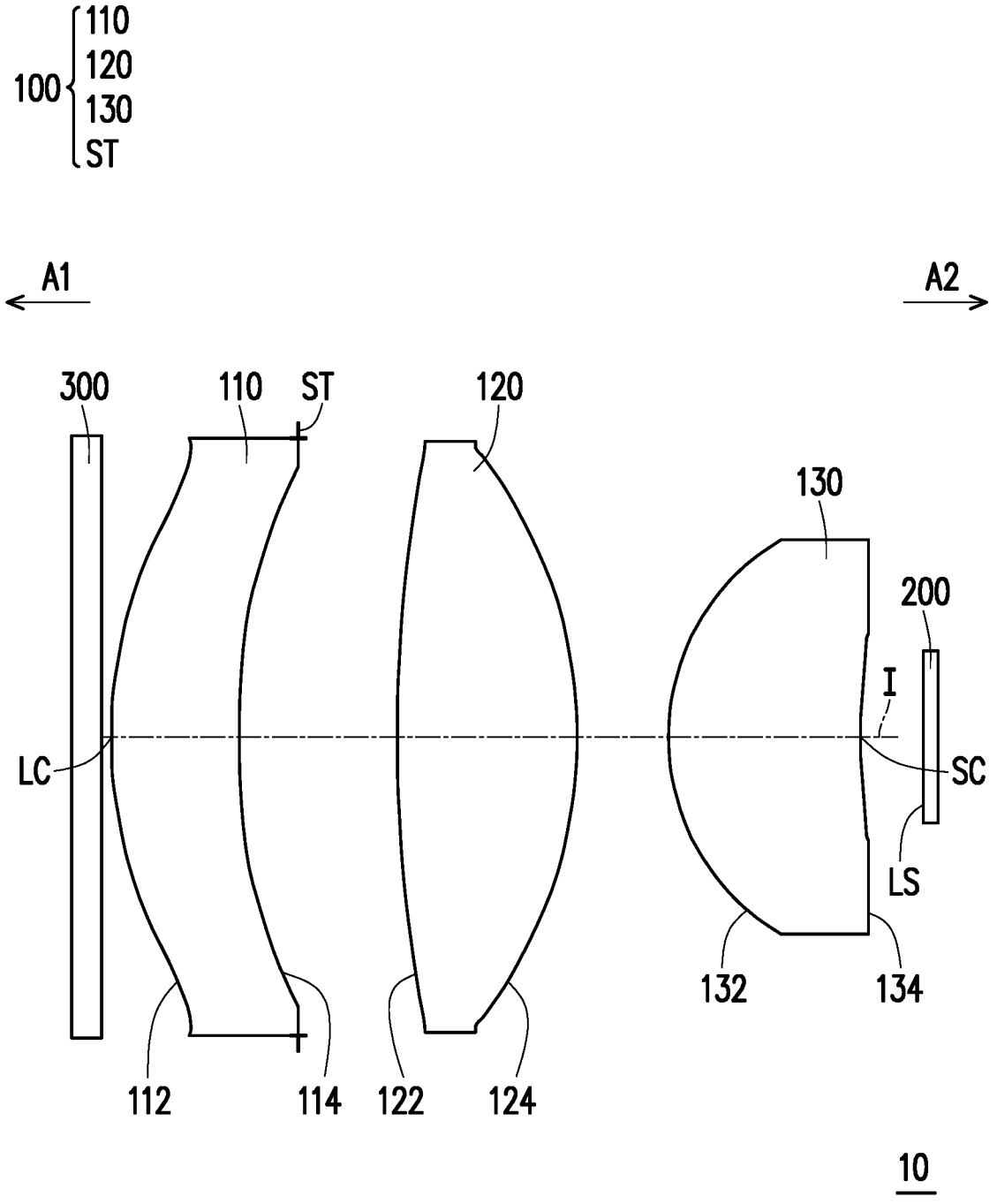

FIG. 3A is a schematic diagram of the vehicle lamp device 10 according to the third embodiment of the disclosure. FIG. 3B shows detailed optical data of the vehicle lamp device according to the third embodiment of the disclosure. FIG. 3C shows aspheric parameters of the vehicle lamp device according to the third embodiment of the disclosure. Referring to FIGS. 3A to 3C, the third embodiment of the vehicle lamp device 10 of the disclosure is roughly similar to the first embodiment, and the differences between the two embodiments are as follows. The first lens 110 is a meniscus lens, and the reduction side surface 114 of the first lens 110 is a concave surface. The aperture ST is disposed on the reduction side surface 114 of the first lens 110, for example, the reduction side surface 114 of the first lens 110 is used as the aperture, or a mechanic part surrounding the reduction side surface 114 of the first lens 110 is used as the aperture. In addition, the first lens 110, the second lens 120, and the third lens 130 have different parameters, including optical data, aspheric coefficients, and spacing of each element.

In addition, in this embodiment, a thickness of the second lens 120 on the optical axis I is greater than 12 millimeters. A distance between the second lens 120 and the third lens 130 on the optical axis I is greater than 1 millimeter. That is, a distance between the reduction side surface 124 of the second lens 120 and the magnification side surface 132 of the third lens 130 on the optical axis I is greater than 1 millimeter. In addition, in this embodiment, a distance between the aperture ST and the second lens 120 on the optical axis I is greater than 2 millimeters.

Figure 4A:
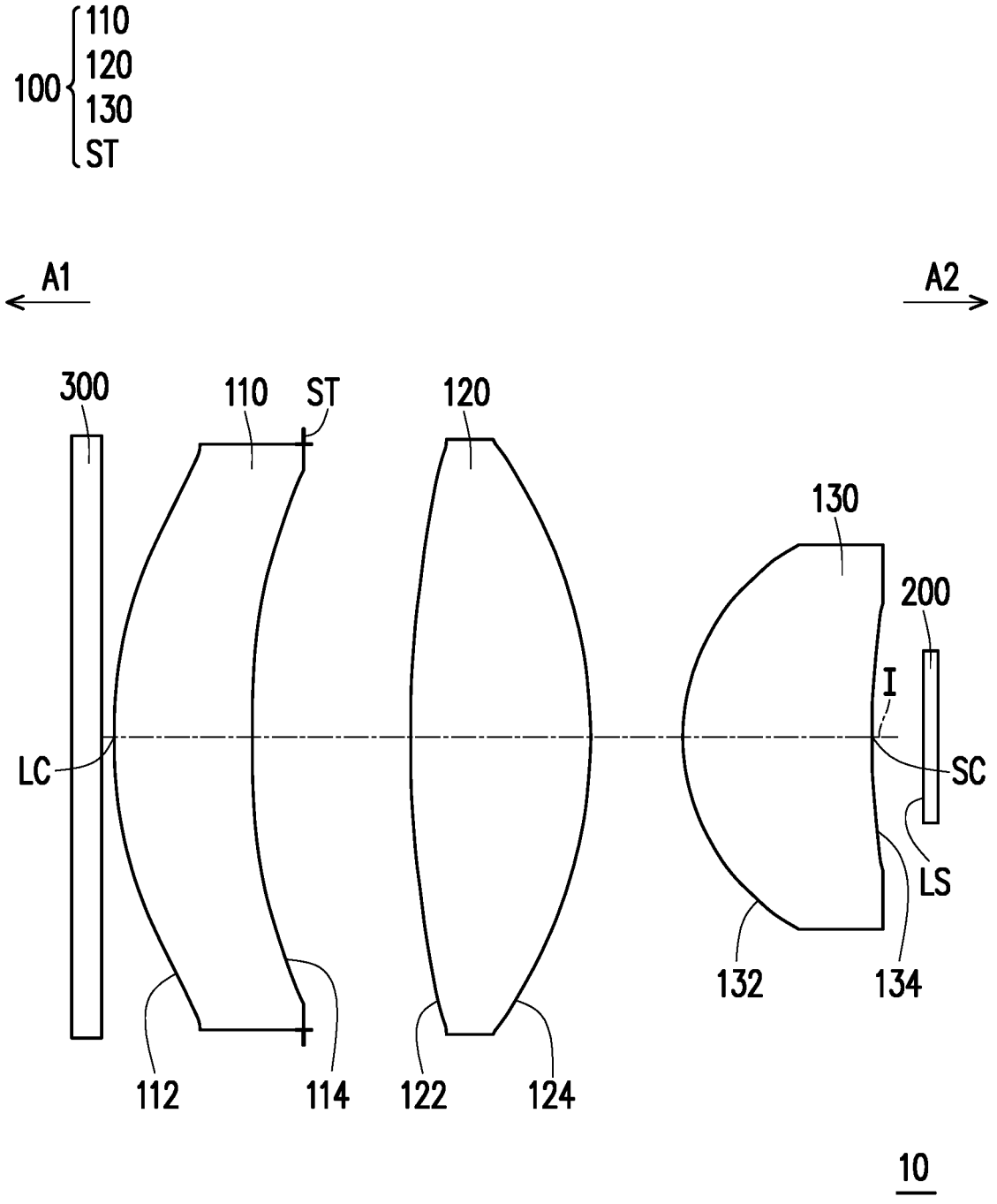

FIG. 4A is a schematic diagram of the vehicle lamp device 10 according to the fourth embodiment of the disclosure. FIG. 4B shows detailed optical data of the vehicle lamp device according to the fourth embodiment of the disclosure. FIG. 4C shows aspheric parameters of the vehicle lamp device according to the fourth embodiment of the disclosure. Referring to FIGS. 4A to 4C, the fourth embodiment of the vehicle lamp device 10 of the disclosure is roughly similar to the third embodiment, and the difference between the two embodiments is as follows. The first lens 110, the second lens 120, and the third lens 130 have different parameters, including optical data, aspheric coefficients, and spacing of each element.

Figure 5A:
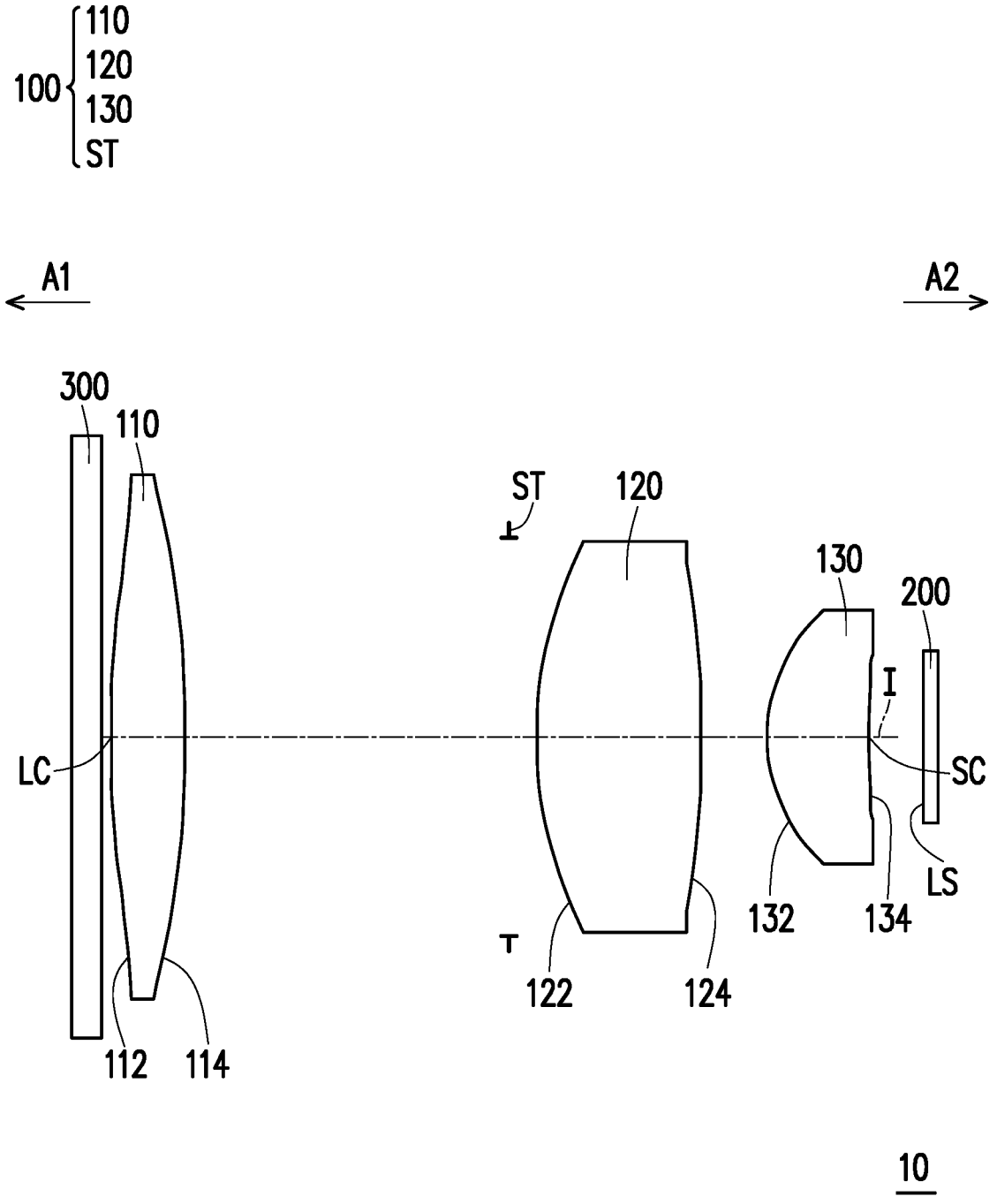

FIG. 5A is a schematic diagram of the vehicle lamp device 10 according to the fifth embodiment of the disclosure. FIG. 5B shows detailed optical data of the vehicle lamp device according to the fifth embodiment of the disclosure. FIG. 5C shows aspheric parameters of the vehicle lamp device according to the fifth embodiment of the disclosure. Referring to FIGS. 5A to 5C, the fifth embodiment of the vehicle lamp device 10 of the disclosure is roughly similar to the third embodiment, and the differences between the two embodiments are as follows. The first lens 110 is a biconvex lens, and the reduction side surface 114 of the first lens 110 is a convex surface. The aperture ST is disposed between the first lens 110 and the second lens 120. In addition, the first lens 110, the second lens 120, and the third lens 130 have different parameters, including optical data, aspheric coefficients, and spacing of each element.

Figure 6A:
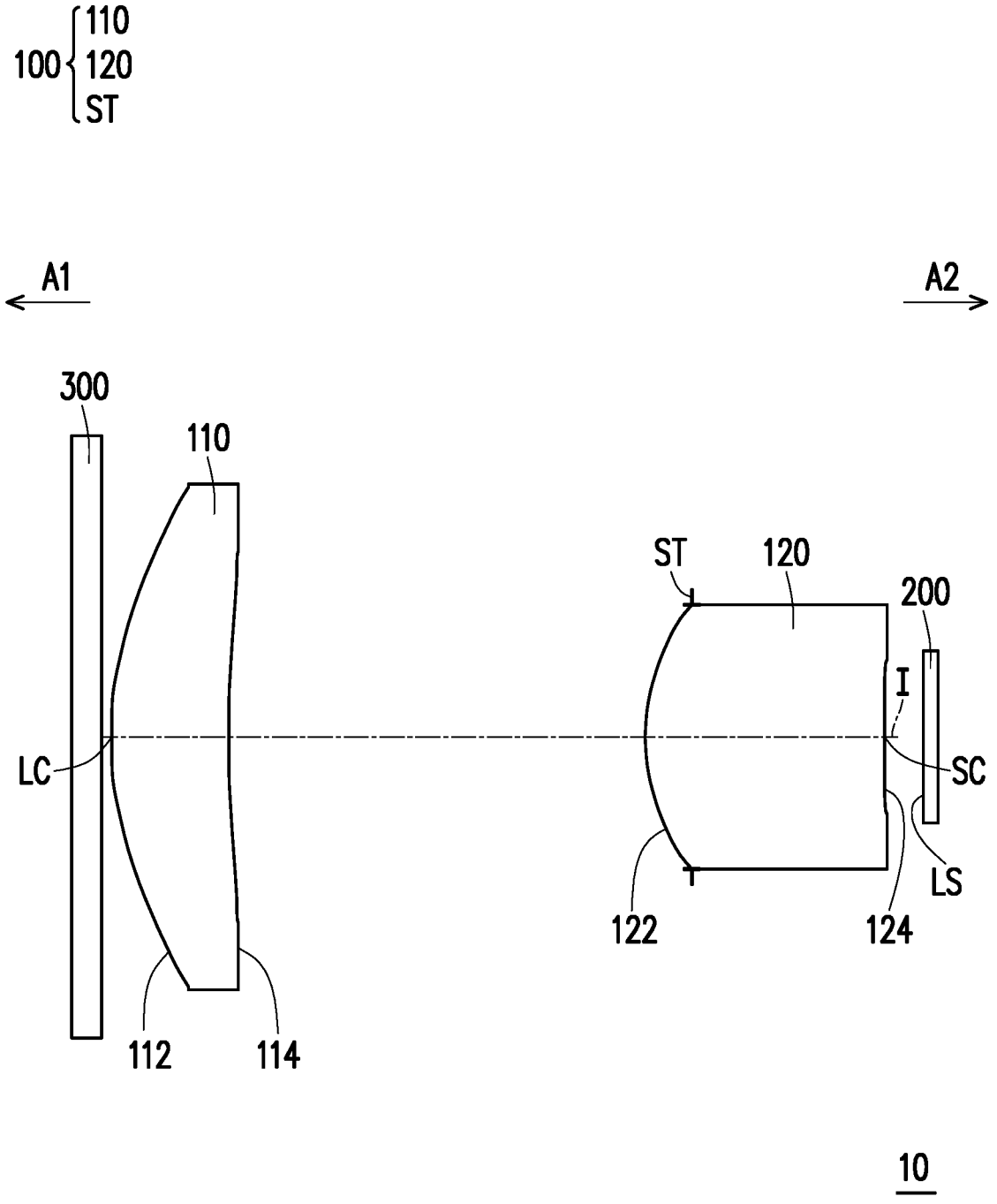

FIG. 6A is a schematic diagram of the vehicle lamp device 10 according to the sixth embodiment of the disclosure. FIG. 6B shows detailed optical data of the vehicle lamp device according to the sixth embodiment of the disclosure. FIG. 6C shows aspheric parameters of the vehicle lamp device according to the sixth embodiment of the disclosure. Referring to FIGS. 6A to 6C, the sixth embodiment of the vehicle lamp device 10 of the disclosure is roughly similar to the first embodiment, and the difference between the two embodiments is as follows. The projection lens 100 of this embodiment includes two diopter lenses. Specifically, the projection lens 100 includes the first lens 110 and the second lens 120 in order from the magnification side A1 to the reduction side A2.

The first lens 110 is a plastic lens and an aspheric lens. The first lens 110 has a positive diopter and is a meniscus lens. In the first lens 110, the magnification side surface 112 facing the magnification side Al is a convex surface, and the reduction side surface 114 facing the reduction side A2 is a concave surface.

The second lens 120 has a positive diopter and is a meniscus lens. In the second lens 120, the magnification side surface 122 facing the magnification side Al is a convex surface, and the reduction side surface 124 facing the reduction side A2 is a concave surface. In addition, in this embodiment, a thickness of the second lens 120 on the optical axis I is greater than 12 millimeters.

The projection lens 100 of this embodiment further includes the aperture ST. In this embodiment, the aperture ST is disposed between the outermost lens surfaces (that is, the magnification side surface 112 of the first lens 110 and the reduction side surface 124 of the second lens 120) at both ends of the projection lens 100. An F-number is between 0.6 and 0.85. The aperture ST may be disposed on a surface of one of the lenses. In this embodiment, the aperture ST is disposed on the magnification side surface 122 of the second lens 120, for example, the magnification side surface 122 of the second lens 120 is used as the aperture, or a mechanic part surrounding the magnification side surface 122 of the second lens 120 is used as the aperture.

In this embodiment, the magnification side surface 122 and the reduction side surface 124 of the second lens 120 may both be aspherical and may be spherical, too, and the disclosure is not limited thereto. The second lens 120 may be a plastic lens or a glass lens, and the disclosure is not limited thereto. Other detailed optical data of this embodiment are shown in FIGS. 6B and 6C. Aspherical coefficients of the magnification side surface 112 and the reduction side surface 114 of the first lens 110 are respectively shown in the fields of FIG. 6C.

In addition, in this embodiment, the lens total length TTL of the projection lens 100 is less than 80 millimeters. That is, a distance between the luminous surface LS of the matrix image light source 200 and a lens surface (i.e., the magnification side surface 112 of the first lens 110) of the projection lens 100 farthest from the matrix image light source 200 on the optical axis I is less than 80 millimeters.

In this embodiment, the distance between the optical centers LC and SC of the outermost lens surfaces at both ends of the projection lens 100 is between 54 millimeters and 76 millimeters. That is, a distance (a total length of the multiple lenses of the projection lens 100 on the optical axis) between an optical center of the magnification side surface 112 of the first lens 110 and an optical center of the reduction side surface 124 of the second lens 120 is between 54 millimeters and 76 millimeters. In addition, a projection aspect ratio of the projection lens 100 is between 2.5:1 and 6:1, so that the projection lens 100 may provide a horizontal angle of view of between 14 and 40 degrees and a vertical angle of view of between 5 and 10 degrees, so as to provide projection that complies with relevant regulations.

In summary, in the vehicle lamp device and projection lens of the disclosure, the projection lens includes two to three diopter lenses. The total length of the multiple lenses on the optical axis is between 54 millimeters and 76 millimeters, and the disposition of the projection lens conforms to the projection aspect ratio of between 2.5:1 and 6:1. The vehicle lamp device or the projection lens according to the embodiments of the disclosure may use a small number of lenses and provide a large aperture and high light-emitting efficiency in projection or illumination, and may meet regulatory requirements. Therefore, production cost may be reduced, and illumination and warning may be improved or energy consumption may be reduced. In addition, the projection lens according to the embodiments of the disclosure has a short lens total length; therefore, when the projection lens is used as a vehicle illumination apparatus such as a vehicle lamp device, the flexibility of the overall assembly may be improved.

Although the disclosure has been disclosed in the above by way of embodiments, the embodiments are not intended to limit the disclosure. Those with ordinary knowledge in the technical field can make various changes and modifications without departing from the spirit and scope of the disclosure. Therefore, the scope of protection of the disclosure is defined by the scope of the appended claims.

What is claimed is:

1. A vehicle lamp device, comprising:

a matrix image light source;

a projection lens, disposed in a downstream of an optical path of the matrix image light source; and a vehicle lampshade, disposed in a downstream of an optical path of the projection lens;

wherein the projection lens comprises two to three diopter lenses, and a distance between optical centers of outermost lens surfaces at both ends of the projection lens is between 54 millimeters and 76 millimeters.

2. The vehicle lamp device according to claim 1, wherein a projection aspect ratio of the projection lens is between 2.5:1 and 6:1.

3. The vehicle lamp device according to claim 1, wherein the matrix image light source satisfies the condition that a spatial frequency is 10 line pairs/millimeter.

4. The vehicle lamp device according to claim 1, wherein the matrix image light source comprises a plurality of micro light emitting diodes.

5. A projection lens for a vehicle lamp, comprising:

two to three diopter lenses;

wherein an aperture of the projection lens is disposed between outermost lens surfaces at both ends of the projection lens, and the projection lens satisfies the following conditions:

(1) an F-number is between 0.6 and 0.85;

(2) a distance between optical centers of the outermost lens surfaces at both ends of the projection lens is between 54 millimeters and 76 millimeters; and (3) a projection aspect ratio is between 2.5:1 and 6:1.

6. The projection lens according to claim 5, wherein the projection lens is adapted for a vehicle lamp device, wherein the vehicle lamp device comprises a matrix image light source and a vehicle lampshade, the projection lens is disposed in a downstream of an optical path of the matrix image light source, and the vehicle lampshade is disposed in a downstream of an optical path of the projection lens.

7. The projection lens according to claim 5, wherein the projection lens satisfies the condition that diopters of the two to three diopter lenses are all positive.

8. The projection lens according to claim 7, wherein the projection lens is adapted for a vehicle lamp device, wherein the vehicle lamp device comprises a matrix image light source and a vehicle lampshade, the projection lens is disposed in a downstream of an optical path of the matrix image light source, and the vehicle lampshade is disposed in a downstream of an optical path of the projection lens.

9. The projection lens according to claim 5, wherein the projection lens satisfies the condition that the two to three diopter lenses are two diopter lenses, and shapes of the two diopter lenses are an aspheric lens and a meniscus lens in order from a magnification side to a reduction side.

10. The projection lens according to claim 9, wherein the projection lens is adapted for a vehicle lamp device, wherein the vehicle lamp device comprises a matrix image light source and a vehicle lampshade, the projection lens is disposed in a downstream of an optical path of the matrix image light source, and the vehicle lampshade is disposed in a downstream of an optical path of the projection lens.

11. The projection lens according to claim 5, wherein the projection lens satisfies the condition that the two to three diopter lenses are three diopter lenses, and shapes of the three diopter lenses are an aspheric lens, a biconvex lens, and a meniscus lens in order from a magnification side to a reduction side.

12. The projection lens according to claim 11, wherein the projection lens is adapted for a vehicle lamp device, wherein the vehicle lamp device comprises a matrix image light source and a vehicle lampshade, the projection lens is disposed in a downstream of an optical path of the matrix image light source, and the vehicle lampshade is disposed in a downstream of an optical path of the projection lens.

13. The projection lens according to claim 5, wherein the two to three diopter lenses are three diopter lenses, the three diopter lenses are a first lens, a second lens, and a third lens in order from a magnification side to a reduction side, and the three diopter lenses satisfy one of the following conditions: (1) a distance between the second lens and the third lens on an optical axis is greater than 1 millimeter; (2) a distance between the aperture and the second lens on an optical axis is greater than 2 millimeters; (3) a thickness of the second lens on an optical axis is greater than 12 millimeters.

14. The projection lens according to claim 13, wherein the projection lens is adapted for a vehicle lamp device, wherein the vehicle lamp device comprises a matrix image light source and a vehicle lampshade, the projection lens is disposed in a downstream of an optical path of the matrix image light source, and the vehicle lampshade is disposed in a downstream of an optical path of the projection lens.

15. The projection lens according to claim 5, wherein the two to three diopter lenses are two diopter lenses, the two diopter lenses are a first lens and a second lens in order from a magnification side to a reduction side, and the two diopter lenses satisfy the following condition: a thickness of the second lens on an optical axis is greater than 12 millimeters.

16. The projection lens according to claim 15, wherein the projection lens is adapted for a vehicle lamp device, wherein the vehicle lamp device comprises a matrix image light source and a vehicle lampshade, the projection lens is disposed in a downstream of an optical path of the matrix image light source, and the vehicle lampshade is disposed in a downstream of an optical path of the projection lens.

17. The projection lens according to claim 5, wherein the projection lens satisfies one of the following conditions: (1) the lenses are glass-plastic hybrid lenses; (2) the projection lens does not comprise a glued lens; (3) the projection lens at least comprises one plastic lens.

18. The projection lens according to claim 17, wherein the projection lens is adapted for a vehicle lamp device, wherein the vehicle lamp device comprises a matrix image light source and a vehicle lampshade, the projection lens is disposed in a downstream of an optical path of the matrix image light source, and the vehicle lampshade is disposed in a downstream of an optical path of the projection lens.

19. The projection lens according to claim 5, wherein the aperture is disposed on a surface of one of the lenses.

20. The projection lens according to claim 19, wherein the projection lens is adapted for a vehicle lamp device, wherein the vehicle lamp device comprises a matrix image light source and a vehicle lampshade, the projection lens is disposed in a downstream of an optical path of the matrix image light source, and the vehicle lampshade is disposed in a downstream of an optical path of the projection lens.

* * * * *